US005782688A

United States Patent [19]

Baek et al.

[11] Patent Number: 5,782,688

[45] Date of Patent: Jul. 21, 1998

[54] APPARATUS FOR CLOSING AN AIR OUTLET DOOR OF AN AIR CONDITIONER

[75] Inventors: Chul-Ho Baek, Seongnam; Jong-Whal Kim, Suwon, both of Rep. of Korea

[73] Assignee: Samsung Electronics Co., Ltd. Suwon, Rep. of Korea

[21] Appl. No.: 816,384

[22] Filed: Mar. 13, 1997

[30] Foreign Application Priority Data

| | | | |
|---|---|---|---|
| Mar. 21, 1996 | [KR] | Rep. of Korea | 1996-7778 |
| Mar. 21, 1996 | [KR] | Rep. of Korea | 1996-7779 |
| Mar. 21, 1996 | [KR] | Rep. of Korea | 1996-7781 |
| Jan. 22, 1997 | [KR] | Rep. of Korea | 1997-1791 |

[51] Int. Cl.[6] ..... F24F 1/02; F24F 13/20

[52] U.S. Cl. ..... 454/233; 62/84; 454/324; 49/214

[58] Field of Search ..... 454/145, 233, 454/234, 236, 259, 275, 276, 324, 201, 202; 62/89, 180

[56] References Cited

U.S. PATENT DOCUMENTS

| | | | |
|---|---|---|---|
| 1,712,562 | 5/1929 | Jeffers | 49/214 |
| 4,152,872 | 5/1979 | Tanizaki et al. | 49/214 |
| 4,733,511 | 3/1988 | Muth | 49/213 X |
| 5,461,855 | 10/1995 | Lee et al. | 454/236 X |

FOREIGN PATENT DOCUMENTS

| | | | |
|---|---|---|---|
| 607361 | 8/1948 | United Kingdom | 49/214 |

*Primary Examiner*—Harold Joyce

*Attorney, Agent, or Firm*—Burns, Doane, Swecker & Mathis, L.L.P.

[57] ABSTRACT

An air conditioner includes an air inlet and an air outlet. A door is movable vertically to open and close the air outlet. The door is guided for movement in guide slots which are configured to cause either a lower portion of the door, or the entire door, to move horizontally toward the air outlet during the closing operation. A spring may be provided to bias the closed door against the air outlet.

16 Claims, 10 Drawing Sheets

APPARATUS FOR CLOSING AN AIR OUTLET DOOR OF AN AIR CONDITIONER

BACKGROUND OF THE INVENTION

1. Field of the Invention

The present invention relates to an air conditioner, and more particularly to a discharge outlet opening and closing apparatus of an air conditioner for preventing foreign objects and the like from entering thereinto through a discharge outlet when the air conditioner is stopped.

2. Description of the Prior Art

As shown in FIG. 1A, a conventional air conditioner includes a front panel 20 centrally disposed on a body 10 of an indoor unit, and a control unit 30 provided at a lower end of the front panel 20 in order to control an operation of the air conditioner.

In addition, a suction inlet 40 and a discharge outlet 50 are arranged at a predetermined interval at upper and lower ends of the body 10 of the indoor unit so as to suck in and discharge an indoor air.

The suction inlet 40 is arranged with a suction grille 41 for supporting a filter member(not shown) and for forming an attractive exterior appearance thereof. The discharge outlet 50 is provided with a plurality of horizontal wind direction blades 51 and vertical wind direction blades 52 so as to control a wind direction of wind supplied therethrough.

However, there is a problem in the conventional air conditioner thus constructed in that foreign objects and the like flow into an interior of the air conditioner when it is stopped to thereby require frequent cleaning thereof.

There is another problem in that the foreign objects flowing into the air conditioner are discharged all at once through the discharge outlet 50 when the air conditioner is initially operated, to thereby pollute the indoor air and reduce a cleanness of the indoor air.

There is still another problem in that an external appearance of the air conditioner looks unbecoming when it is all covered by a vinyl cover or the like lest the foreign objects should flow into the interior of the air conditioner through the discharge outlet 50 when it is not used for a long time.

In order to overcome the above-mentioned problems, another prior art discharge outlet opening and closing apparatus of an air conditioner was disclosed in FIG. 1B and FIG. 2. Throughout the FIG. 1B and FIG. 2, like reference numerals are used for designation of like or equivalent parts or portions as in FIG. 1A.

The discharge outlet opening and closing apparatus of an air conditioner is mounted, as illustrated in FIGS. 1B through 3, by support means 60 to an indoor unit body 10 (refer to FIG. 1A), and a driving means 70 is disposed on the support means 60 so as to be driven in forward/reverse directions by an electric power according to a control signal of a control unit 30.

A motor axle 71 of the driving means 70 (that is, a motor) is coupled to a pinion 80 through a through hole **61*a* formed in a support member 61. That is, the pinion 80 is rotatably coupled to the motor axle 71 so as to be rotated by the driving force of the driving means 70**.

The pinion 80 is meshed with a rack 90 which receives a rotary movement of the pinion 80 and then performs a linear movement.

The rack 90 is provided with a door 100 which is vertically actuated by the vertical linear movement of the rack 90 and is guided by the support means 60 to thereby open and close a discharge outlet 50.

The support means 60 is provided with a plurality of position detecting sensors 110 for detecting the vertical movement of the door 100.

Meanwhile, the support member 61 is provided with a through-hole **61*a* at a predetermined position in order to allow the motor axle 71 of the driving means 70** to be supported thereby.

Two guide members 62 are symmetrically mounted at both ends of the support member 61 so as to allow a plurality of horizontal blades 51 and vertical blades 52 to be supported in a space of the discharge outlet 50 formed at the upper portion of the support member 61, and at the same time, so as to allow the door 100 to vertically move in front of the support member 61 to thereby open and close the discharge outlet 50.

A guide roller 63 is rotatably disposed at a central lower front surface of the support member 61 so as to keep the pinion 80 and the rack 90 in mesh, and at the same time, to facilitate vertical movement of the rack 90.

As shown in FIGS. 2 and 3 the rack 90 is meshed to the pinion 80 at a bottom end thereof and is supported by the guide roller 63 lest it should be detached therefrom.

The upper end of the rack 90 is fixedly connected to a central upper end of the door 100 by a plurality of fastening bolts 91.

The door 100 includes a body 101 for covering the discharge outlet 50.

A plurality of rolling members 102 rotatably mounted at both lower and upper side ends of the body 101, make contact with inner surfaces of concave grooves **62*a* of the guide member 62, and roll while preventing the body 101 from being horizontally swayed to thereby move the body 101** smoothly in a vertical direction.

At this time, the body 101 is integrally formed at a bottom side thereof with a position detecting protrusion 103 so as to induce an operation of the plurality of position detecting sensors 110 when the body 101 is vertically moved.

However, there is a problem in the discharge outlet opening and closing apparatus of an air conditioner according to the prior art thus constructed, in that the discharge outlet 50 is closed or opened when the pinion 80 and the rack 90 are driven by the driving means 70 and then the body 101 of the door 100 is moved vertically, and the operation of the driving means 70 is controlled by position detecting sensors 110 which detect the vertical height of the body 101, so that the manufacturing cost is increased and the whole structure is complicated because of the use of the position detecting sensors 110.

Furthermore, there is another problem in that the plural rolling members 102, which are rotatably mounted at both lower and upper side ends of the body 101 to make contact with the guide member 62 and roll when the body 101 of door 100 is moved vertically, are easily detached whereby the body 101 severely sways during the vertical movement of the body 101.

SUMMARY OF THE INVENTION

Accordingly, it is a first object of the present invention to provide a discharge outlet opening and closing apparatus of an air conditioner which beautifies an external appearance of a door of the air conditioner and at the same time closes the door without a stepped gap being formed.

It is a second object of the present invention to provide a discharge outlet opening and closing apparatus of an air conditioner in which the discharge outlet can be opened and closed by a rack and a link having a spring so as to provide a door with elasticity constantly when the door is moved or stopped.

To accomplish the first object of the present invention, there is provided a discharge outlet opening and closing apparatus of an air conditioner having a door for closing and opening a discharge outlet formed at one side of a front surface of an indoor unit body, the apparatus comprising a door having a plurality of protrusions at both sides thereof, and one side of a rear surface of which is connected to connecting unit so that the door can be moved vertically, left and right guide units disposed at both sides of a front panel at a predetermined interval, a fixing member one side of which is connected to the door, a support unit connected to the fixing member, and a driving unit disposed at a predetermined internal position of the indoor unit body.

To accomplish the second object of the present invention, there is provided a discharge outlet opening and closing apparatus of an air conditioner having a door for closing and opening a discharge outlet formed at one side of a front surface of an indoor unit body, the apparatus comprising a door having a plurality of protrusions at both sides thereof, and an upper hook at one side of a rear surface thereof so that a hanging rod can be connected thereto, left and right guide units disposed at both sides of a front panel at a predetermined interval, a support unit having a rack and one side of which is connected to the door, and a driving unit disposed at a predetermined internal position of the indoor unit body.

BRIEF DESCRIPTION OF THE DRAWINGS

For a fuller understanding of the nature and objects of the invention, reference should be made to the following detailed description taken in conjunction with the accompanying drawings in which.

DESCRIPTION OF THE PREFERRED EMBODIMENTS

Preferred embodiments of the present invention will now be described in detail with reference to the accompanying drawings and firstly, a first embodiment will be described with reference to FIGS. 4 and 5.

Figure 1A:
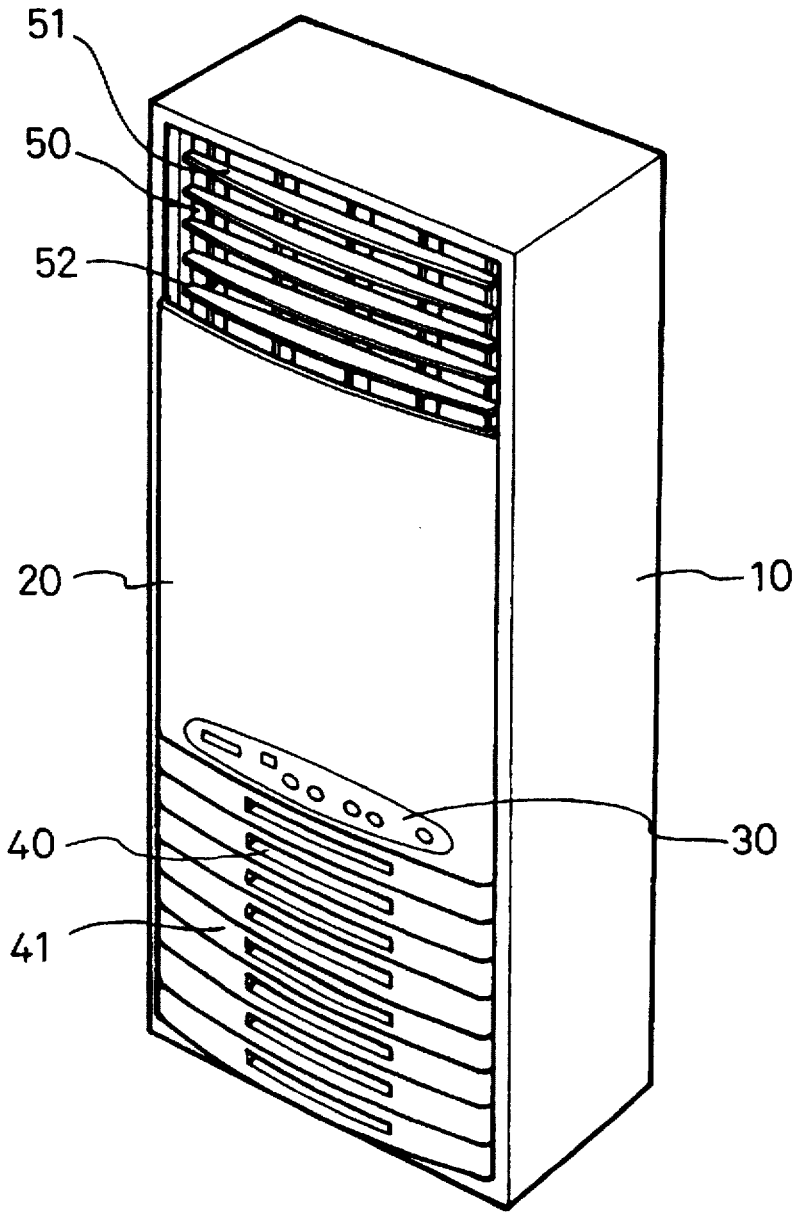
FIG.1A (PRIOR ART)
FIG. 1A is a perspective view for illustrating an air conditioner according to one embodiment of the prior art.
Figure 1B:
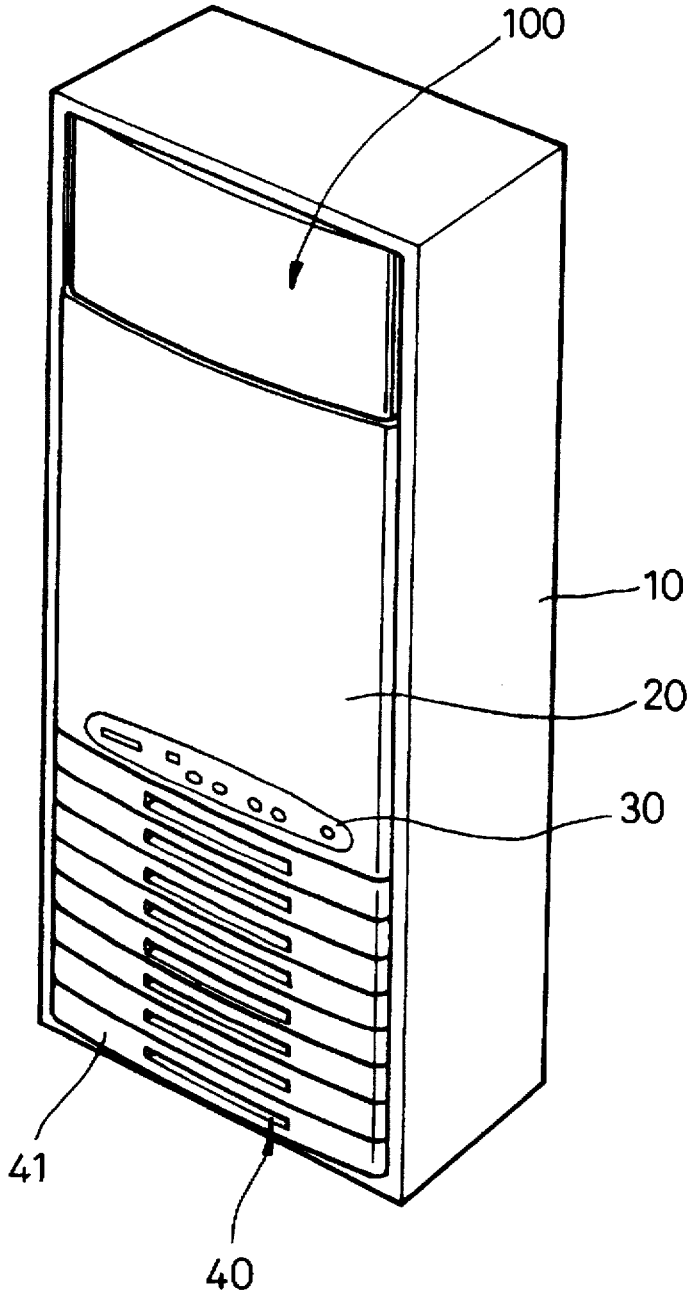
FIG. 1B (PRIOR ART)
FIG. 1B is a perspective view for illustrating an air conditioner according to another embodiment of the prior art.
Figure 2:
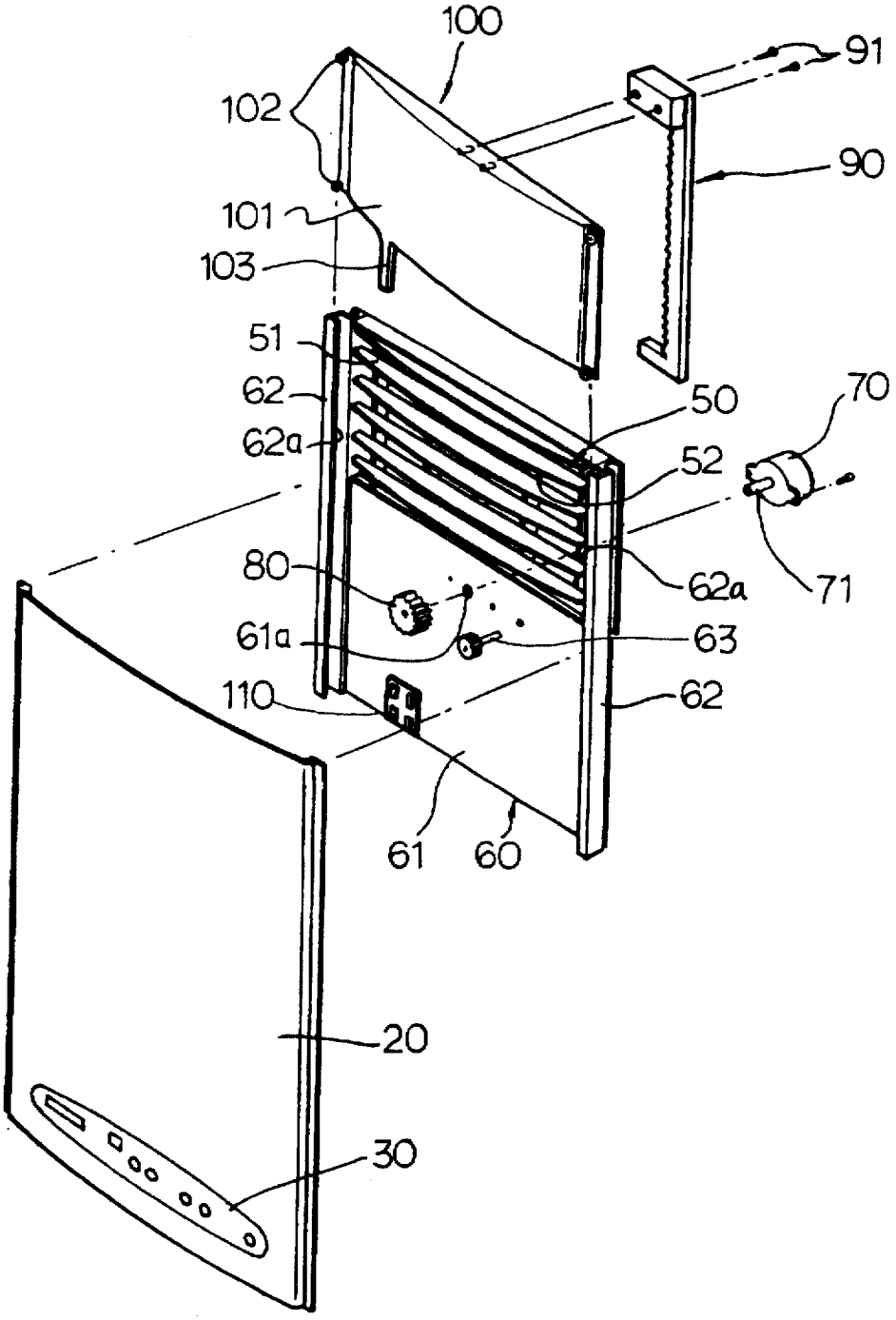
FIG.2 (PRIOR ART)
FIG. 2 is an exploded perspective view for illustrating a discharge outlet opening and closing apparatus in FIG. 1B.
Figure 3:
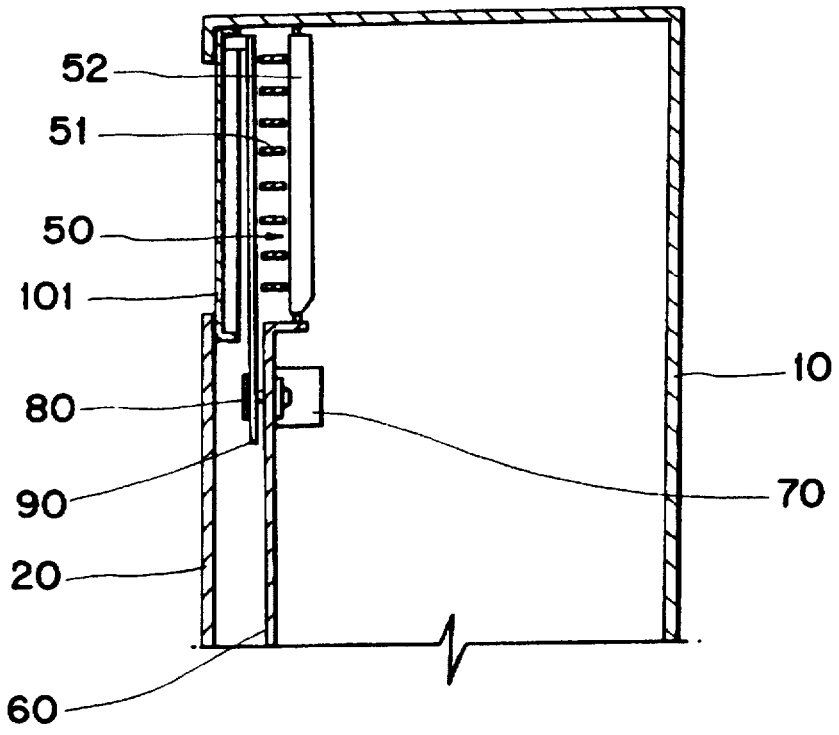
FIG.3 (PRIOR ART)
FIG. 3 is a vertical sectional view for illustrating principal parts in FIG. 2.
Figure 4:
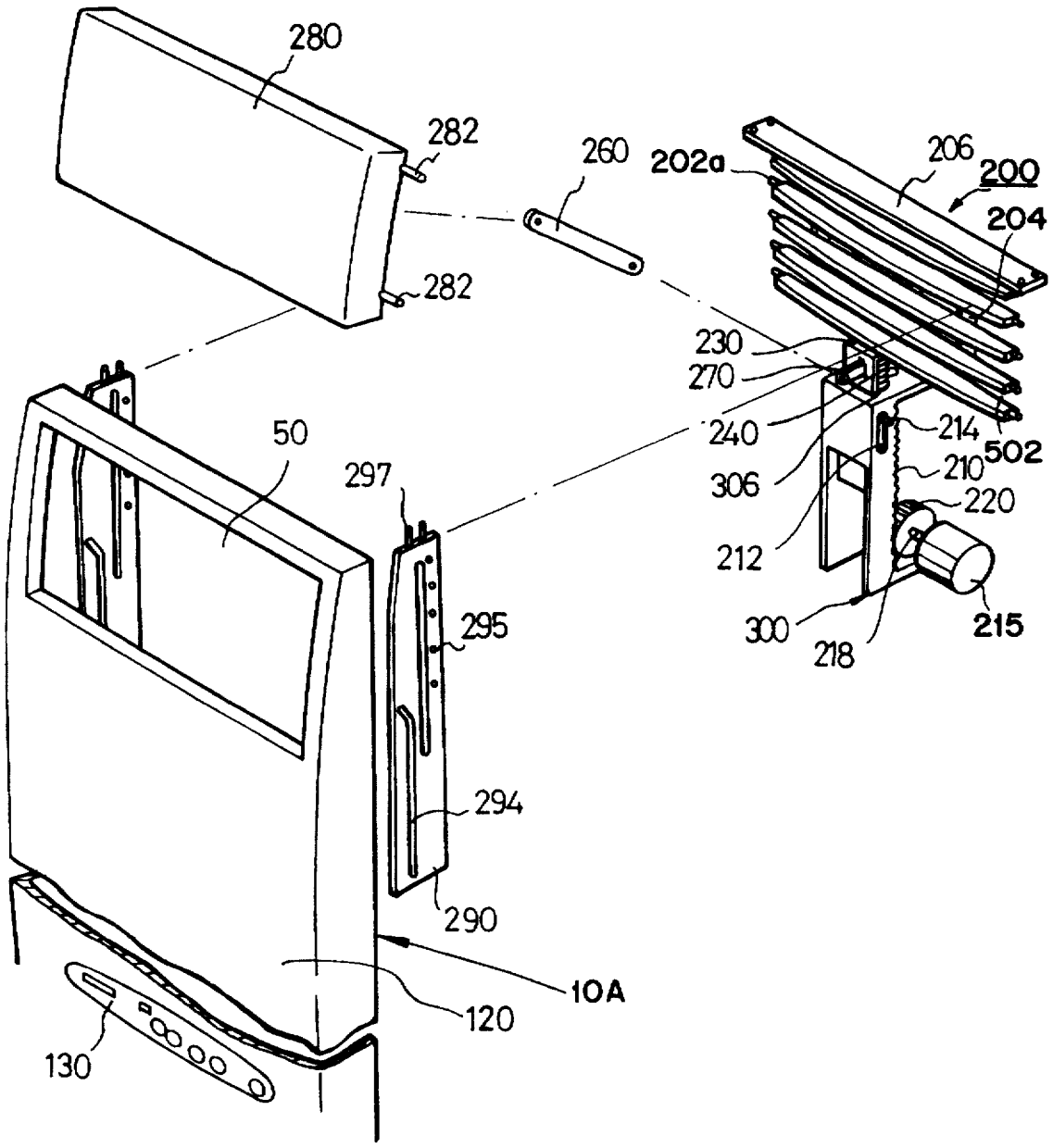
FIG. 4 is an exploded perspective view for illustrating a discharge outlet opening and closing apparatus of an air conditioner according to a first embodiment of the present invention.
Figure 5:
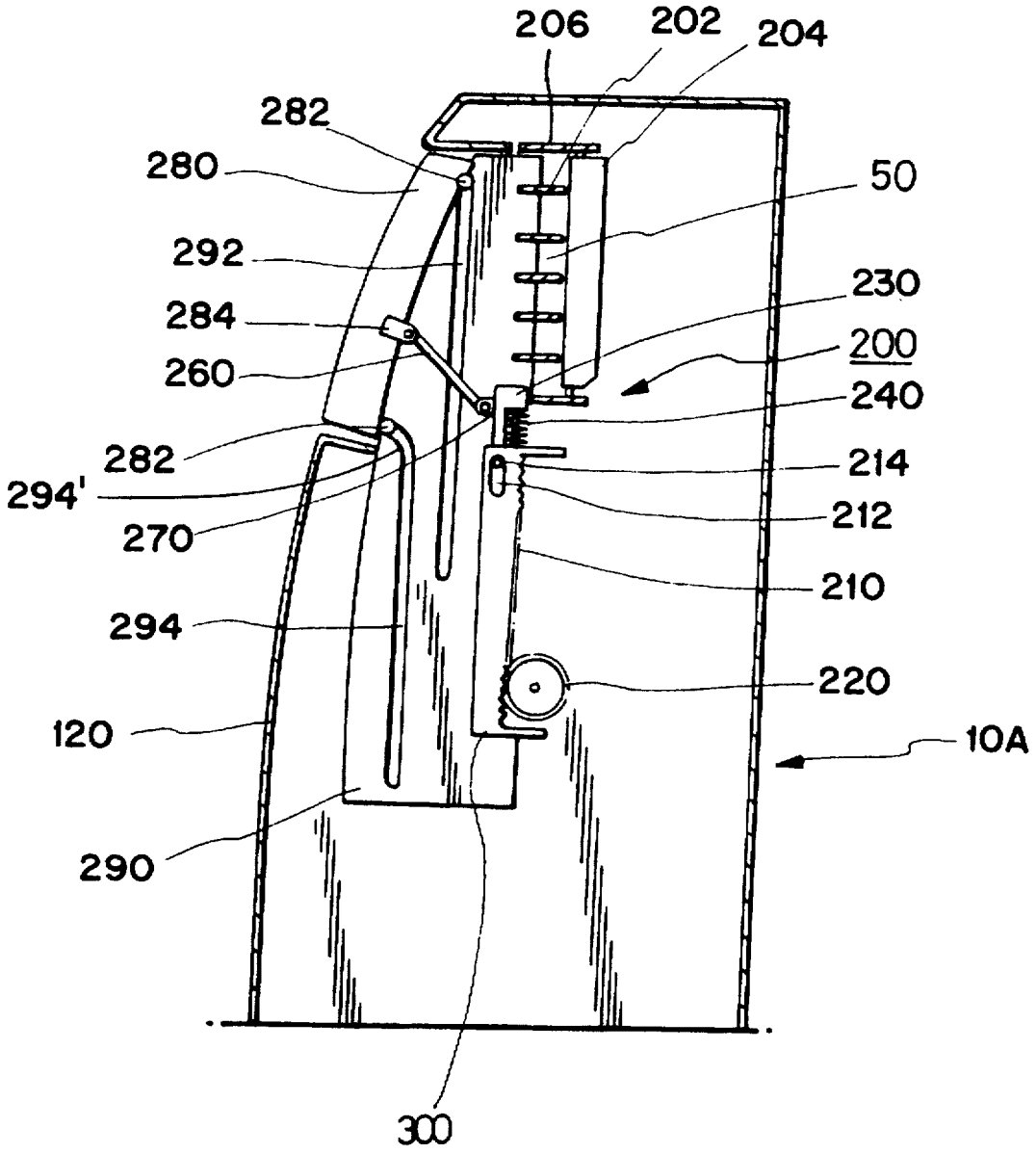
FIG. 5 is a vertical sectional view through the air conditioner shown in FIG. 4 for illustrating a state where a discharge outlet is closed by a door.

As shown in FIGS. 4 and 5, an indoor unit body 10A includes a front panel 120, and a control unit 130 is provided at a lower end of the front panel 120 in order to control an operation of an air conditioner according to the first embodiment of the present invention.

In FIG. 4, reference numeral 200 defines a discharge outlet opening and closing unit which serves to prevent foreign particles and the like from entering the air conditioner through an air discharge outlet 50 when the air conditioner is not working.

The discharge outlet opening and closing unit 200 includes a door 280, left and right guide means 290 and 290 disposed at both sides of the front panel 120 at a predetermined interval, a fixing member 230 connected to the door 280 at one side thereof, support means 300 connected to the fixing member 230, and driving means 215.

An upper rail groove 292 and a lower rail groove 294 are at a predetermined interval formed in the left and right guide means 290 and 290 so as to allow a plurality of protrusions 282 formed on both sides of the door 280 to be inserted thereinto.

A plurality of holes 295 are at regular intervals formed behind the upper rail groove 292 so that protruding portions **202*a* formed at both ends of horizontal wind direction blades 202** can be inserted thereinto.

As shown in FIG. 4, an upper end of the lower rail groove 294 is curved toward the outlet 50 so as to facilitate the opening and closing of the door 280.

In addition, a plurality of protrusions 297 are at predetermined intervals formed at upper ends of the left and right guide means 290 and 290 so as to be inserted into a support plate 206.

The support means 300 includes a vertical guide slot 212 at one side of an upper portion thereof. A guide pin 214 attached to the fixing member 230 is inserted into the guide slot 212 in order to guide one end portion of the fixing member 230 more smoothly. In addition, a rack 210 is vertically formed at one side of the support means 300.

The rack 210 is meshed with a pinion 220 which is rotatably connected to a shaft 218 of the driving means 215. In other words, the rack 210 is able to move vertically according to the rotation of the pinion 220 connected to the driving means 215.

The support means 300 is provided with a through hole 306 at a predetermined position of an upper surface 302 thereof. The fixing member 230 is of inverted L-shape and is inserted into the through hole 306. A spring 240 is fixedly disposed within the fixing member 230, and a protruding portion 270 is mounted at an outside of the fixing member.

The protruding portion 270 is connected to connecting means 260 (that is, a link), described below, by means of a pin (not shown). In other words, the protruding portion 270 is connected to the door 280 through the connecting means 260 one end of which is connected to the door 280.

As shown in FIG. 5, the door 280 includes a fixing part 284 at a predetermined position of the rear surface thereof.

One end of the connecting means 260 is connected to the fixing part 284, and the other end thereof is connected to the protruding portion 270 formed at one side of the fixing member 230.

In addition, since the protrusions 282 are inserted into the upper and lower rail grooves 292 and 294 formed in the left and right guide means 290 and 290, the door 280 is able to be moved vertically along the upper and lower rail grooves 292 and 294.

Next, the operation of the discharge outlet opening and closing apparatus according to the first embodiment of the present invention will be described.

When a control unit 130 disposed at the front panel 120 is manipulated to operate the driving means 215 so that the discharge outlet 50 can be closed in a state where the air conditioner is stopped, the driving means 215 is driven.

Since the shaft 218 of the driving means 215 is connected to the pinion 220, the pinion 220 is rotated by the rotation of the shaft 218 of the driving means 215. Meanwhile, the rack 210 is moved upward in a straight line according to the rotation of the pinion 220. When the rack 210 formed at one side of the support means 300 is nearly moved to its uppermost position, an upper end of the door 280 is in nearly surface-contact with the support plate 206, and a lower end thereof is located at the bottom of a curved portion 294 of the lower rail groove 294 (see FIG. 5). At this time, when the driving means 215 is continuously driven for a predetermined time, a driving force applies a compression force to the spring 240 disposed within the fixing member 230, and the compression force of the spring 240 pushes up the member 230 and the lower end portion of the door 280 to the top of the curved portion of the lower rail groove 294. Thus, the lower portion of the door is moved horizontally toward the air outlet to thereby close the door 280 thoroughly.

As shown in FIG. 5, since the door 280 is closed thoroughly, foreign particles and the like are prevented from flowing into the air conditioner through the discharge outlet 50, and the external appearance of the discharge outlet 50 is attractive when the air conditioner is not used. In addition, the door 280 adheres closely to the front panel 120, so that there is no stepped gap therebetween.

On the other hand, when a user manipulates the control unit 130 provided at the front panel 120 in order to open the door 280, the driving means 215 is driven and then the pinion 220 connected to the shaft 218 of the driving means 215 is rotated in a reverse direction.

That is, the spring 240 disposed within the fixing member 230 is extended during an initial opening of the door 280, and the lower portion of the door 280 travels for a predetermined displacement along the curved portion of the lower rail groove 294 of the guide means 290. Consequently, the door 280 is moved downward according to the descent of the support means 300.

At this time, the predetermined displacement can be compensated by changing the shape of the protruding portion 270 connected to the connecting means 260 to some extent. That is, the displacement can be compensated if the connecting means 260 is rotatably connected to a hole of the protruding portion 270 with some clearance.

The connecting means 260 connected to the fixing member 230 pulls down the door 280 according to the movement of the fixing member 230. In other words, since the protrusions 282 of the door 280 are inserted into the upper rail groove 292 and the lower rail groove 294, the door 280 is guided downward along the upper and lower rail grooves 292 and 294 when the fixing member 230 is moved downward.

As described above, in the discharge outlet opening and closing apparatus of the air conditioner according to the first embodiment of the present invention, since the door is opened and closed by means of a link, a rack, and a rack connection unit, there is no stepped gap. In addition, since the door is opened and closed without the stepped gap, foreign particles or dust cannot flow into the air conditioner through the discharge outlet, and the external appearance is beautified.

The second embodiment of the present invention will now be described in detail with reference to the accompanying drawings.

Throughout the drawings, like reference numerals and symbols are used for designation of like or equivalent parts or portions as in FIGS. 4 and 5, and redundant references will be omitted for simplicity of illustration and explanation.

Figure 6:
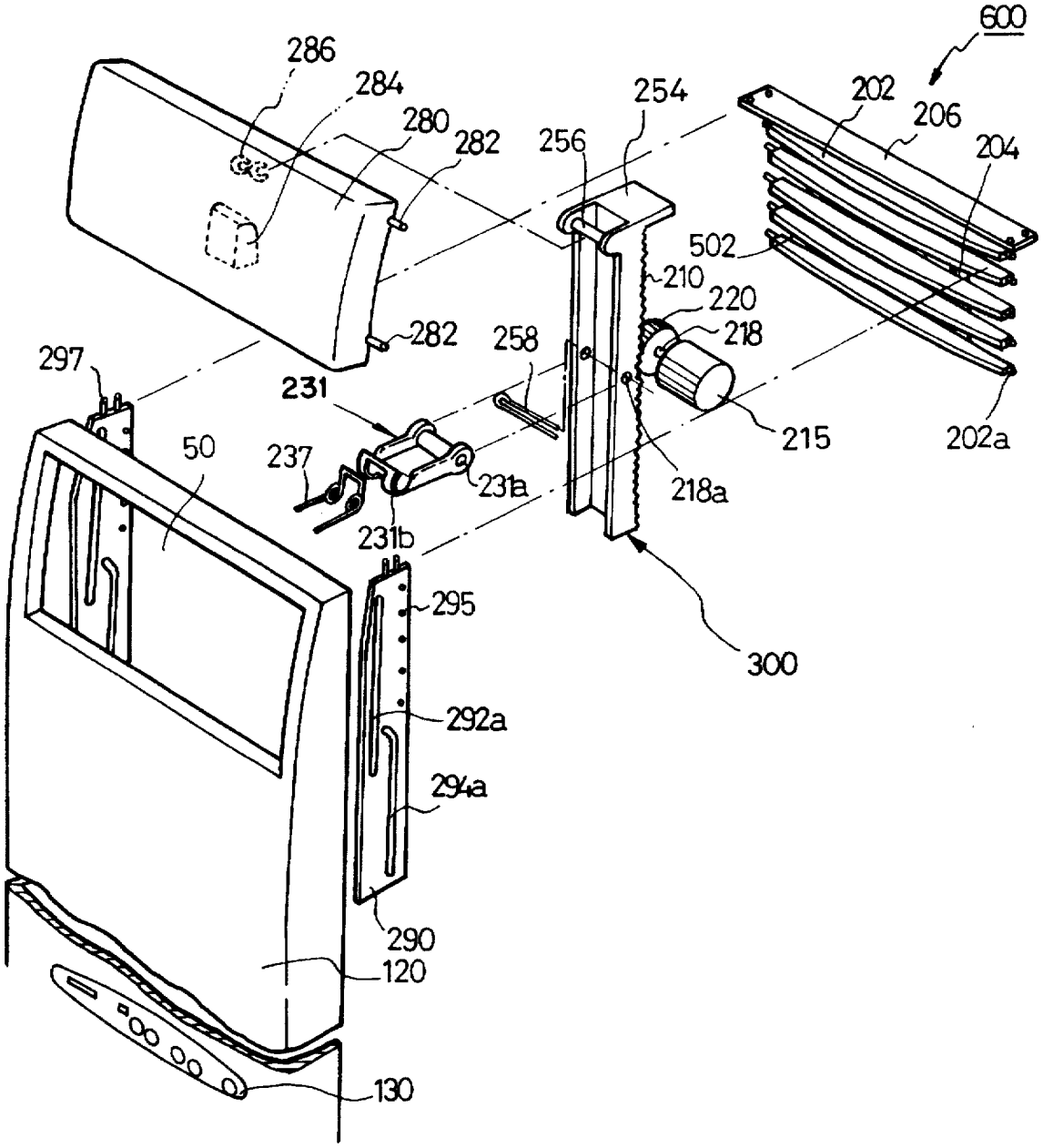
FIG. 6 is an exploded perspective view for illustrating a discharge outlet opening and closing apparatus of an air conditioner according to a second embodiment of the present invention.

In FIG. 6, reference numeral 600 designates a discharge outlet opening and closing unit which prevents foreign particles from entering the air conditioner through the discharge outlet 50 when the air conditioner is not operated.

The discharge outlet opening and closing unit 600 includes a door 280, left and right guide means 290 and 290 which are disposed at a predetermined interval at both sides of the front panel 120, support means 300 having a rack 210 and connected to the door 280 at one side thereof, and driving means 215.

The rack 210 is vertically oriented at one side of the support means 300, and a rod 256 connected to an upper hook 286 of the door 280 is formed at one side of an upper portion of the support means 300. In addition, a through hole **218*a* is formed at a middle portion of the support means 300**.

As shown in FIG. 6, the through hole **218*a* is located at the same position as a through hole 231*a* formed at one end of a link 231, and a hinge pin 258 is inserted into the through holes 218*a* and 231*a* to thereby connect the link 231 to the support means 300**.

As described above, the link 231 is provided with the through hole **231*a* at one side thereof and an arch-shaped curved portion 231*b* at the other side thereof so that an elastic means, that is, a curved glasses-shaped spring 237** can be inserted thereinto.

Figure 7:
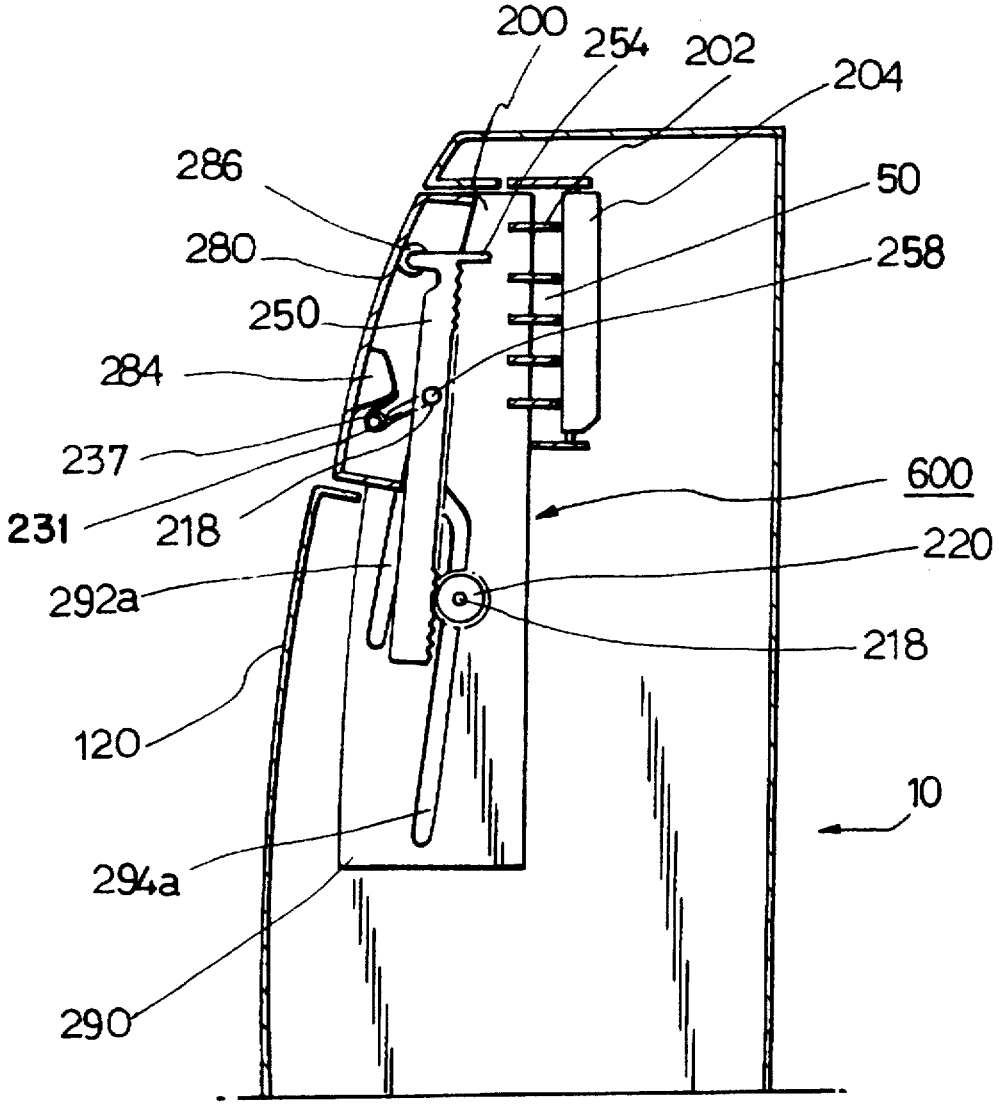
FIG. 7 is a vertical sectional view through the air conditioner shown in FIG. 6 for illustrating a state where a discharge outlet is closed by a door according to the second embodiment of the present invention.

As shown in FIGS. 6 and 7, the rear surface of the door 280 is provided with the upper hook 286, so that the rod 256 of the support means 300 can be rotatably inserted thereinto. A link guiding protrusion 284 for guiding the link 231 is formed at a middle portion of the rear surface of the door 280. In addition, a plurality of protrusions 282 are at a predetermined interval formed at both sides of the door 280.

The plurality of protrusions 282 of the door are inserted into a first guide groove **292*a* and a second guide groove 294*a* which are at a predetermined interval formed vertically in the left and right guide means 290 and 290 that are fixed at both sides of the indoor unit body 10. Accordingly, the door 280 can be vertically moved along the first guide groove 292*a* and the second guide groove 294*a***.

Since an upper end of the second guide groove **294*a* is curved toward the air outlet 50, the door 280 can be closed without forming a stepped gap with respect to the front panel 120**.

Next, the operation of the discharge outlet opening and closing apparatus according to the second embodiment of the present invention will be described.

When a control unit 130 disposed at the front panel 120 is manipulated to operate the driving means 215 so that the discharge outlet 50 can be closed in a state where the air conditioner is stopped, the driving means 215 is driven.

Since the shaft 218 of the driving means 215 is connected to the pinion 220, the pinion 220 is rotated by the rotation of the shaft 218 of the driving means 215. Meanwhile, the rack 210 is moved upward in a straight line according to the rotation of the pinion 220.

Since the rod 256 formed at one side of the upper portion of the support means 300 is connected to the door 280, the door 280 is moved upward when the rack 210 is moved. In other words, the door 280 is moved upward along the first and second guide grooves 292*a* and 294*a* formed in the left and right guide means 290 and 290. The upper portions of the lower guide grooves 294*a* guide the lower portion of the door horizontally toward the air outlet.

At this time, since the spring 237 of the link 231 continuously and elastically supports the link guiding protrusion 284 formed at the rear surface of the door 280 while the rack 210 of the support means 300 is moved, the door 280 continuously maintains a predetermined elastic state during its movement.

As shown in FIG. 7, since the door 280 is closed thoroughly, foreign particles and the like are prevented from flowing into the air conditioner through the discharge outlet 50, and the external appearance of the discharge outlet 50 is more attractive when the air conditioner is not used. In addition, the door 280 adheres closely to the front panel 120, so that there is no stepped gap therebetween.

On the other hand, when a user manipulates the control unit 130 provided at the front panel 120 in order to open the door 280, the driving means 215 is driven and then the pinion 220 connected to the shaft 218 of the driving means 215 is rotated in a reverse direction.

When the pinion 220 is rotated in the reverse direction, the rack 210 formed at one side of the support means 300 is also moved downward. If the rack 210 is moved downward, the door 280 connected to the rack 210 is also moved downward. At this time, since the plurality of protrusions 282 formed at the both ends of the door 280 are inserted into the first and second guide grooves 292*a* and 294*a*, the door 280 is moved downward along the first and second guide grooves 292*a* and 294*a*.

In other words, since the link guiding protrusion 284 of the door 280 and the spring 237 of the link 231 are, in a state where elasticity is maintained, moved according to the movement of the rack 210 while the door 280 is moved downward, the door 280 is continuously maintained in an elastic state during the descent thereof.

As described above, in the discharge outlet opening and closing apparatus of the air conditioner according to the second embodiment of the present invention, since the door 280 adheres closely to the front panel 120, there is no stepped gap. In addition, since the door is opened and closed without the stepped gap, foreign particles or dust cannot flow into the air conditioner through the discharge outlet, and the external appearance is beautified.

The third embodiment of the present invention will now be described in detail with reference to FIGS. 8–10.

Throughout the drawings, like reference numerals and symbols are used for designation of like or equivalent parts or portions as in FIGS. 4 and 5, and redundant references will be omitted for simplicity of illustration and explanation.

Figure 8:
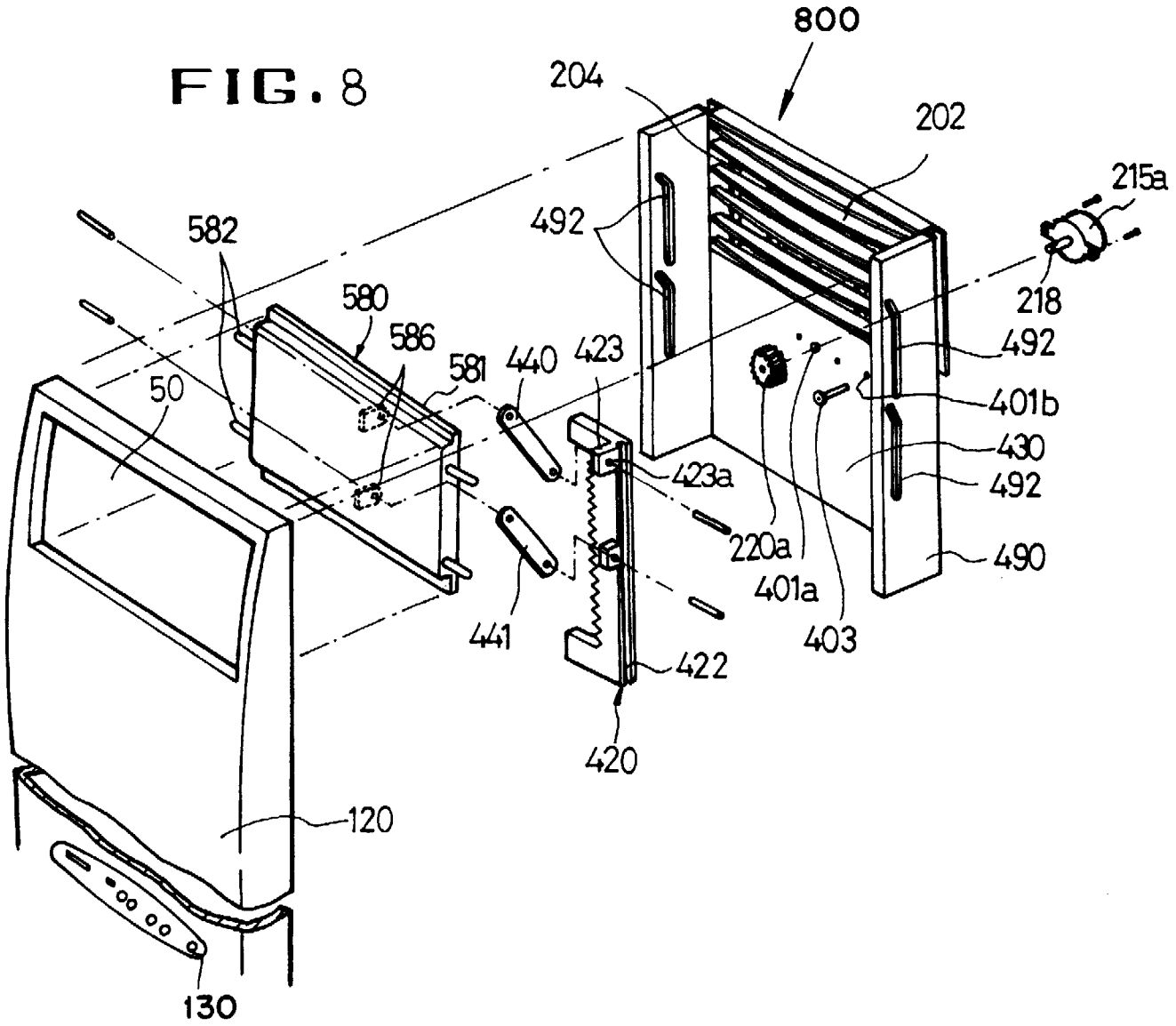
FIG. 8 is an exploded perspective view for illustrating a discharge outlet opening and closing apparatus of an air conditioner according to a third embodiment of the present invention.
Figure 9:
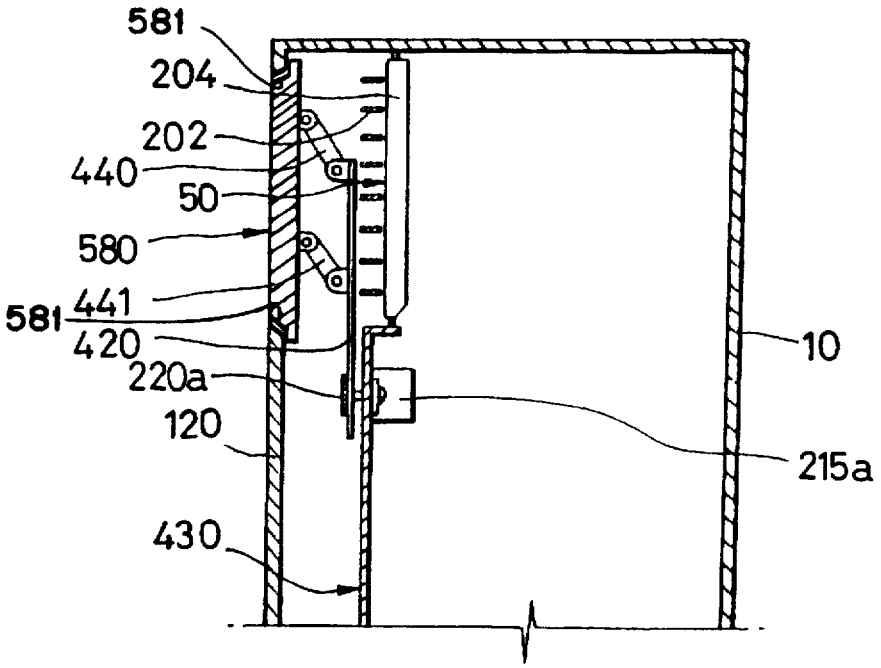
FIG. 9 is a vertical sectional view through the air conditioner shown in FIG. 8 for illustrating a state where a discharge outlet is closed by a door.

In FIG. 8, reference numeral 800 is a discharge outlet opening and closing unit which prevents foreign particles from entering the air conditioner through the discharge outlet 50 when the air conditioner is not operated.

The discharge outlet opening and closing unit 800 includes a door 580, left and right guide means 490 and 490 which are at a predetermined interval disposed at both sides of the front panel 120, first support means 420 having a vertical rack 410 at one side thereof and a plurality of protruding portions 423, second support means 430 fixed to the left and right guide means 490 and 490, and driving means 215*a*.

A plurality of guide grooves 492 and 492 are at predetermined intervals formed in each of the left and right guide means 490 and 490. In addition, upper ends of the guide grooves 492 and 492 are curved so as to open and close the door 580 more easily.

Moreover, a plurality of horizontal wind direction blades 202 and vertical wind direction blades 204 are disposed at a predetermined position of an upper end of the left and right guide means 490 and 490, and the second support means 430 is mounted at a lower end thereof.

A middle portion of the second support means 430 includes a through hole 401*a* so as to accommodate a shaft 218 of the driving means 215*a*. In addition, a through hole 401*b* is formed at a predetermined interval from the through hole 401*a* so as to accommodate a guide roller 403.

Meanwhile, one side of the first support means 420 is provided with the rack 410 which is meshed with a pinion 220*a*, and the other side thereof is provided with a groove 422, so that the guide roller 403 can be inserted thereinto and be vertically moved smoothly, and simultaneously the rack 410 can be prevented from sliding off the roller 403. The plurality of protruding portions 423 having through holes 423*a* are at regular intervals formed at predetermined positions of a front surface of the first support means 420 so as to connect the first support means 420 to a parallelogram arrangement of first and second vertically spaced connecting means (links) 440 and 441 connected to the door 580.

The door 580 includes beveled portions 581 at upper and lower ends thereof so that the door 580 can adhere closely to corresponding beveled edges of the discharge outlet 50 of the front panel 120. The door 580 also includes, at both sides thereof, a plurality of protrusions 582 inserted into the guide grooves 492 and 492 of the left and right guide means 490 and 490 so as to open and close the discharge outlet 50 during the vertical movement of the door 580. In addition, the door 580 is at predetermined positions of the rear surface thereof provided with a plurality of connecting portions 586 connected to one side of the first and second connecting means 440 and 441 by means of connecting pins (reference numerals are not shown). Moreover, portions adjacent to the beveled portions 581 are round-shaped, so that the door 580 can be easily slid along the curved portions formed at the upper ends of the guide grooves 492.

One side of the first and second connecting means 440 and 441 is connected to the connecting portions 586 of the door 580 through the pins (reference numerals are not shown), and the other side thereof is connected to the through holes 423*a* of the protruding portions 423 formed at the first support means 420 through connecting pins 450.

Meanwhile, the shaft 218 of the driving means 215*a* is inserted into the through hole 401*a* of the second support means 430, and is rotatably connected to the pinion 220*a*.

Next, the operation the discharge outlet opening and closing apparatus according to the third embodiment of the present invention will be described.

When a control unit 130 disposed at the front panel 120 is manipulated to operate the driving means 215*a* so that the discharge outlet 50 can be closed in a state where the air conditioner is stopped, the driving means 215*a* is driven.

Since the shaft 218 of the driving means 215*a* is connected to the pinion 220*a*, the pinion 220*a* is rotated by the rotation of the shaft 218 of the driving means 215*a*. When the pinion 220*a* is rotated, the rack 410 meshed with the pinion 220*a* converts a rotation motion of the pinion 220*a* into a linear motion and moves upward the first support means 420.

At this time, since the first support means 420 is connected to the door 580 through the first and second connecting means 440 and 441, the door 580 is moved upward. In other words, while the plural protrusions 582 are guided, which are protruded at upper and lower ends at both ends of the door 580 and inserted into the guide grooves 492 formed at the first and second guide means 490 and 490, the door 580 is smoothly moved upward and then horizontally toward the air outlet, and the beveled portion 581 adheres closely to the discharge outlet 50 of the front panel 120, to thereby close the discharge outlet 50 as shown in FIG. 9. Accordingly, foreign particles are prevented from entering the air conditioner through the discharge outlet 50 and the external appearance of the discharge outlet 50 is more attractive.

Figure 10:
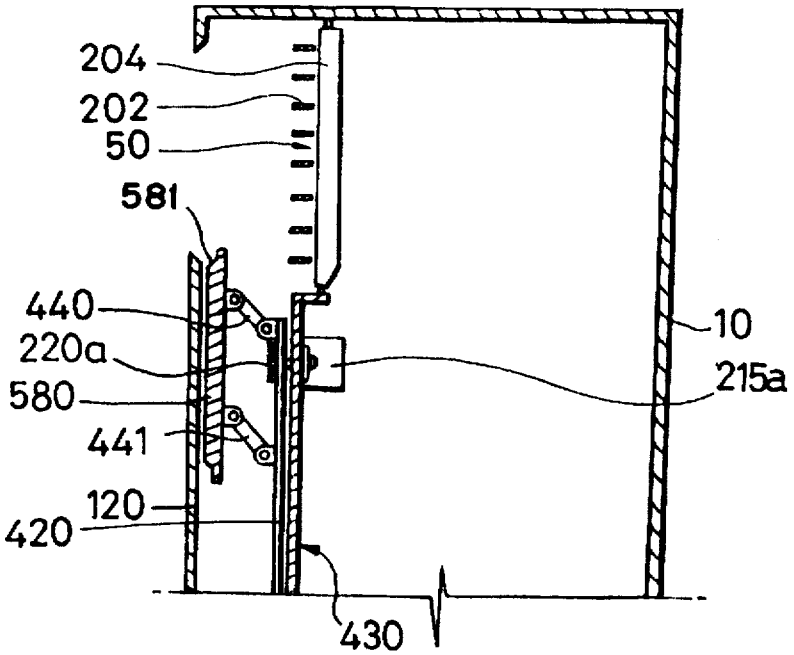
FIG. 10 is a view similar to FIG. 9 for illustrating a state where the discharge outlet is opened.

On the other hand, as shown in FIG. 10, when a user manipulates the control unit 130 provided at the front panel 120 in order to open the door 580, the driving means 215*a* is driven and then the pinion 220*a* connected to the shaft 218 of the driving means 215*a* is rotated in a reverse direction.

Since the rack 410 formed at one side of the first support means 420 is meshed with the pinion 220*a*, the rack 410 converts the rotation motion of the pinion 220*a* into linear motion and is moved downward.

Meanwhile, since the protruding portion 423 formed at the first support means 420 is connected to the connecting portions 586 of the door 580 through the first and second connecting means 440 and 441, the door 580 is moved according to the movement of the rack 410 of the first support means 420.

In other words, when the rack 410 is moved downward, the door 580 is moved downward along the guide grooves 492 because the protrusions 582 of the door 580 are inserted into the guide grooves 492 of the left and right guide means 490 and 490, to thereby open the discharge outlet 50 of the air conditioner.

As described above, in the discharge outlet opening and closing apparatus of the air conditioner according to the third embodiment of the present invention, since an inclination of the door is prevented by means of the guide grooves of the left and right guide means, the discharge outlet is smoothly opened and closed by the door, and the external appearance of the discharge outlet is beautified by improving the stepped gap between the front panel and the door.

Having described specific present embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. An air conditioner comprising a body having a front panel in which an air outlet is formed; a pair of vertical guides disposed on opposite vertical sides of the air outlet; a vertically movable door for opening and closing the air outlet, said vertical guides cause movement of at least a portion of the door horizontally toward and away from the air outlet during upward and downward movement, respectively, of the door, the door including a pair of vertical edges and a rear surface extending between the vertical edges; a plurality of protrusions projecting outwardly from each of the vertical edges and guided for vertical movement in the vertical guides; driving means disposed within the body; and a movement transmitting means interconnecting the driving means with the rear surface for transmitting vertical movement from the driving means to the door, the movement transmitting means accommodating the horizontal movement of the portion of the door.

2. The air conditioner according to claim 1 wherein each of the vertical guides includes upper and lower upright rail grooves slidably receiving respective protrusions.

3. The air conditioner according to claim 2 wherein each vertical guide includes vertically spaced holes, a plurality of horizontal air-directing vanes each having opposite ends rotatably mounted in respective ones of the holes.

4. The air conditioner according to claim 3 wherein each vertical guide includes vertical protrusions mounted in the body.

5. The air conditioner according to claim 1 wherein the protrusions comprise upper and lower protrusions disposed on each vertical edge of the door; each vertical guide including upper and lower rail grooves slidably receiving the upper and lower protrusions, each of the lower rail grooves including an upper portion curving toward the air outlet for guiding the lower protrusion horizontally toward and away from the air outlet during upward and downward movement, respectively, of the door.

6. The air conditioner according to claim 5 wherein the movement transmitting means includes elastic means for transmitting a yieldable driving force from the driving means to the door.

7. The air conditioner according to claim 1 wherein the movement transmitting means includes elastic means for transmitting a yieldable driving force from the driving means to the door.

8. The air conditioner according to claim 1 wherein the driving means comprises a motor, the movement transmitting means comprising a rack engaged with the motor to be raised and lowered thereby, and a fixing member mounted to the rack for vertical sliding movement relative thereto, the fixing member connected to the door, and a spring for transmitting vertical force from the rack to the fixing member, whereby the rack is vertically movable relative to the fixing member and door.

9. The air conditioner according to claim 7 wherein the driving means comprises a motor, the transmitting means including a rack engaged with the motor, to be raised and lowered thereby; the elastic means comprising a spring having one end connected to the rack and another end connected to the rear surface of the door.

10. An air conditioner comprising a body forming an air outlet; a pair of vertical guides disposed on opposite vertical sides of the air outlet; a vertically movable door for opening and closing the air outlet, the door being mounted for sliding movement in the guides and including a rear surface facing away from the air outlet, said vertical guides causing a lower portion of the door to be horizontally movable toward and away from the air outlet during upward and downward movement, respectively, of the door; a hook disposed at an upper portion of the rear surface; a drive means; and support means having an upper portion pivotably connected to the hook, and a lower portion shaped as a rack and connected to a pinion of the drive means for transmitting vertical movement from the drive means to the door, the support means accommodating the horizontal movement of the rear portion of the door.

11. The air conditioner according to claim 10 further including an elastic member connected to the support means and arranged to apply an elastic force to the rear surface of the door at a location below the pivot connection between the support means and the door for biasing the lower portion of the door horizontally toward the air outlet.

12. The air conditioner according to claim 11 wherein the rear surface carries a protrusion against which the elastic member is slidably engaged.

13. The air conditioner according to claim 12 further including a link pivotably connected to the support means, the elastic member carried by the link.

14. The air conditioner according to claim 10 wherein each vertical guide includes upper and lower upright guide grooves, the door including opposite vertical edges, each carrying upper and lower protrusions slidably disposed in upper and lower guide grooves, respectively.

15. The air conditioner according to claim 14 wherein each of the lower guide grooves includes an upper portion curved toward the air outlet for guiding the lower portion of the door horizontally toward and away from the air outlet during upward and downward movement, respectively, of the door.

16. The air conditioner according to claim 14 wherein each vertical guide includes a plurality of vertically spaced holes; the air conditioner further including horizontal vanes each having opposite ends pivotably mounted in respective ones of the holes.

* * * * *